US006088887A

United States Patent [19]

Bois

[11] Patent Number: 6,088,887

[45] Date of Patent: Jul. 18, 2000

[54] BAGS COMPRISING MATCHING CLOSURE PROFILES ACTUATED BY SLIDER

[75] Inventor: Henri Georges Bois, Neuilly sur Seine, France

[73] Assignee: Flexico-France, Henonville, France

[21] Appl. No.: 09/202,134

[22] PCT Filed: Apr. 8, 1998

[86] PCT No.: PCT/FR98/00710

§ 371 Date: May 17, 1999

§ 102(e) Date: May 17, 1999

[87] PCT Pub. No.: WO98/45182

PCT Pub. Date: Oct. 15, 1998

[30] Foreign Application Priority Data

Apr. 10, 1997 [FR] France ..... 97 04394

[51] Int. Cl.[7] ..... A44B 19/00; A44B 21/00; B65D 33/00

[52] U.S. Cl. ..... 24/399; 24/400; 24/587

[58] Field of Search ..... 24/399, 400, 587, 24/30.5 P, 576

[56] References Cited

U.S. PATENT DOCUMENTS

| | | | |
|---|---|---|---|
| 2,606,352 | 8/1952 | Wende | 24/400 |
| 3,122,807 | 3/1964 | Ausnit | 24/399 |
| 3,220,076 | 11/1965 | Ausnit et al. | 24/399 |
| 3,259,951 | 7/1966 | Zimmerman | 24/399 |
| 5,067,208 | 11/1991 | Herrington, Jr. et al. . | |
| 5,198,055 | 3/1993 | Wirth et al. | 24/587 |
| 5,216,787 | 6/1993 | Custer et al. | 24/587 |
| 5,442,837 | 8/1995 | Morgan . | |
| 5,664,299 | 9/1997 | Porchia et al. . | |

FOREIGN PATENT DOCUMENTS

| | | | |
|---|---|---|---|
| 1564039 | 4/1969 | France | 24/400 |

*Primary Examiner*—Victor N. Sakran
*Attorney, Agent, or Firm*—Finnegan, Henderson, Farabow, Garrett & Dunner, LLP

[57] ABSTRACT

The present invention relates to a bag having complementary closure strips (30, 40) actuated by cursor (50), the bag being characterized by the fact that it comprises means (60) adapted to ensure sealing between the inside walls of the bag when the bag is in its closed position, said means being in the zone of the bag underlying the strips (30, 40) at their end that receives the cursor (50) in the closed position.

30 Claims, 4 Drawing Sheets

FIG_7
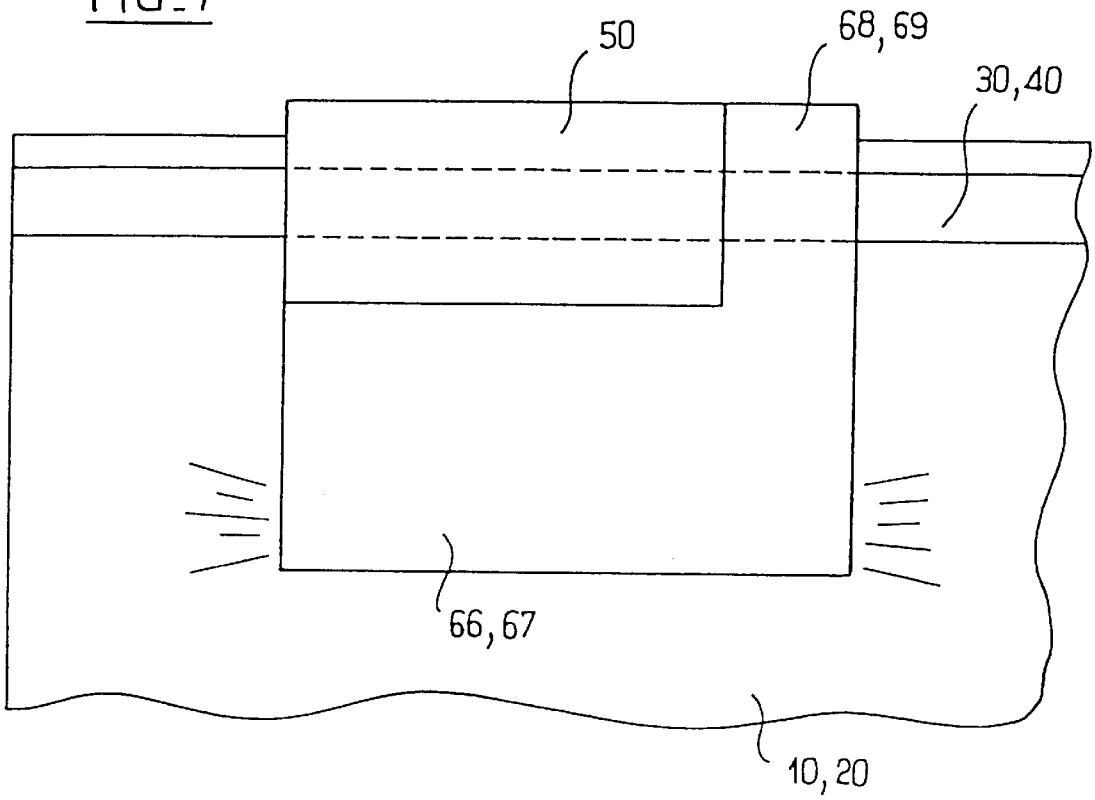
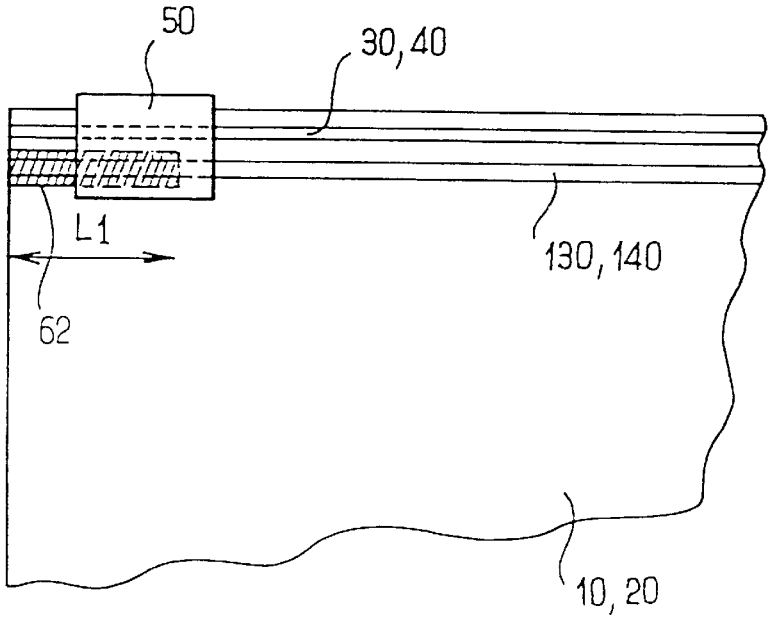
FIG_8

BAGS COMPRISING MATCHING CLOSURE PROFILES ACTUATED BY SLIDER

The present invention relates to the field of bags having complementary closure strips actuated by a cursor both for opening and for closing.

Such bags are described, for example, in the following documents: EP-A-0 479 661, EP-A-0 102 301, EP-A-0 051 010, U.S. Pat. No. 5,007,143, U.S. Pat. No. 5,007,142, U.S. Pat. No. 5,063,644, EP-0051010, EP-0102301, U.S. Pat. No. 5,405,478, and WO94/28752.

Those bags have already given good service.

The cursor makes bags easier to open and close. The presence of the cursor is particularly appreciated by people who are old or visually handicapped.

However, most known bags with cursors do not give full satisfaction. In particular, most such bags do not provide complete sealing when the strips are in the closed position. This lack of sealing is due to the fact that the strips stay apart ahead of the cursor.

Nevertheless, sealing is required in numerous applications, particularly but not exclusively, for bags that are used for deep freezing food.

Attempts have been made to remedy that drawback by proposing closure strips having a local discontinuity in the vicinity of the end which receives the cursor when the bag is in its closed position, such that the cursor penetrates into said discontinuity and makes it possible, in the closed position, for the strips to engage properly over their entire length.

Nevertheless, the means described in those documents are very complex. They also suffer from the major drawback of not retaining the cursor reliably and consequently of running the risk of the cursor being swallowed by a small child, for example.

An object of the present invention is to improve bags having closure strips that are actuated by a cursor so as to improve the sealing thereof.

Other objects of the present invention are to provide means that are simple and that ensure that the cursor is retained reliably.

In the context of the present invention, these objects are achieved by a bag having complementary closure strips actuated by cursor, the bag being characterized by the fact that it comprises means adapted to ensure sealing between the inside walls of the bag when the bag is in its closed position, said means being in the zone of the bag underlying the strips at their end that receives the cursor in the closed position.

In a first embodiment of the present invention, the means for ensuring sealing are formed by heat sealing between the inside walls of the bag in the zone underlying the strips at their end that receives the cursor in the closed position. The heat sealing is preferably formed between the webs of the strips.

In a second embodiment of the present invention, the means for providing sealing are formed by a projection between the inside walls of the bag in the zone underlying the strips at their end that receives the cursor in the closed position. The projection is preferably formed on a strip support web.

In a third embodiment of the present invention, the means for providing sealing are performed by clip means provided on the cursor, adapted to clip together the zone underlying the strips at their end that receives the cursor in the closed position.

In a fourth embodiment, the means for providing sealing are formed by a closure or a baffle situated beneath the first closure adjacent to the mouth of the bag and closed by action of the cursor, the end of the second closure or baffle corresponding to the cursor in the closed position being heat sealed to provide sealing.

Other characteristics, objects, and advantages of the present invention appear on reading the following detailed description with reference to the accompanying drawings given as non-limiting examples, and in which:

FIG. 7 is a side view of the same bag mouth;

FIG. 8 is a fragmentary side view of the mouth of a bag constituting a fourth embodiment of the present invention;

Figure 1:
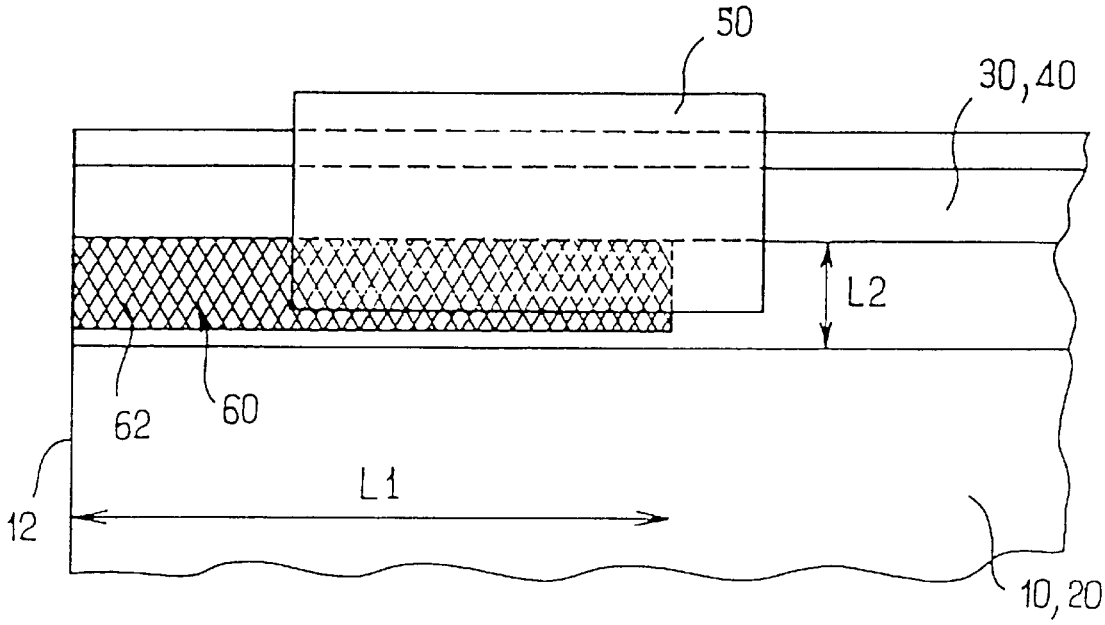
FIG. 1 is a fragmentary side view of the mouth of a bag constituting a first embodiment.
Figure 2:
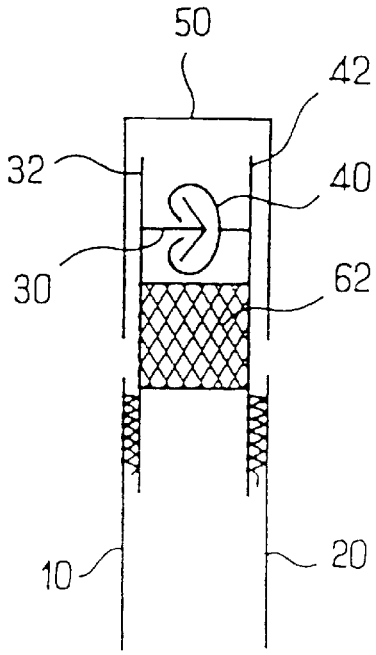
FIGS. 2 and 3 are cross-section views of two variants of the mouth.
Figure 3:
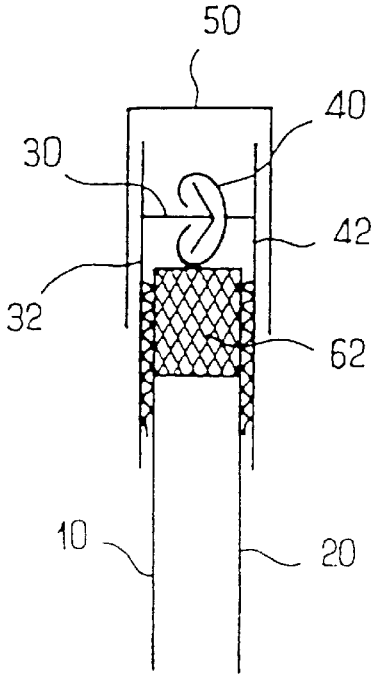

Accompanying FIGS. 1 to 3 are fragmentary views of the mouth of a bag of the present invention.

In these figures, references 10 and 20 designate the two main films making up the bag, 30 and 40 the closure strips carried by respective webs 32 and 42 that are connected to the films, 50 the cursor for actuating the strips both to open them and to close them, and finally reference 60 designates the means for sealing the bag.

The films 10 and 20, the closure strips 30 and 40, and the cursor 50 can be in accordance with presently known dispositions, e.g. in accordance with the teaching of the following documents: EP-A-0 479 661, EP-A-0 102 301, EP-A-0 051 010, U.S. Pat. No. 5,007,143, U.S. Pat. No. 5,007,142, U.S. Pat. No. 5,0636,44, EP-0051010, EP-0102301, U.S. Pat. No. 5,405,478, and WO94/28752. These means are therefore not described in detail below.

It will be observed that the strips 30 and 40 are represented in the accompanying figures in highly diagrammatic manner only. The present invention is not limited in any way to the representations given in the figures.

In the first embodiment of the present invention, the means 60 for sealing the bag are formed by a zone of heat sealing 62. This heat sealing 62 is located in a zone beneath the strips 30 and 40, at their end that receives the cursor 50 in the closed position.

The length of the zone of heat sealing 62 parallel to the strips 30 and 40 is preferably greater than the length of the cursor 50. In typical but non-limiting manner, the zone of heat sealing 62 has a length L1 of about 1.5 cm and a width L2 of about 1 mm to 2 mm.

As can be seen in FIGS. 2 and 3, the webs 32 and 42 carrying the closure strips 30 and 40 can be heat sealed or stuck either to the insides of the films 10 and 20 (see FIG. 2) or to the outsides thereof (see FIG. 3).

In the embodiment shown in FIG. 2, the films 10 and 20 preferably have a heat sealing temperature higher than that of the webs 32 and 42 carrying the strips 30 and 40.

The heat sealing 62 is performed in this context between the webs 32 and 42.

By way of non-limiting example, the webs 32 and 42 can be made of a material selected from the group comprising: polyethylene, ethylene-propylene copolymers, and EVA copolymers; while the films can be made of a material selected from the group comprising:

polypropylene, ethylene-propylene copolymers, mixtures of polypropylene and ethylene-propylene copolymers, and/or terpolymers.

In contrast, in the variant shown in FIG. 3, the films 10 and 20 preferably have a heat sealing temperature that is lower than that of the webs 32 and 42 carrying the strips 30 and 40.

Furthermore, in this context, the heat sealing 62 is provided between the films 10 and 20.

By way of non-limiting example, in this embodiment the webs 32 and 42 can be made of a material selected from the group comprising: polypropylene, ethylene-propylene copolymers, mixtures of polypropylene and ethylene-propylene copolymers, and/or terpolymers, and indeed polyamides; whereas the films can be made of a material selected from the group comprising polyethylene, ethylene-propylene copolymers, and EVA copolymers.

Naturally, the zone of heat sealing 62 must be as close to possible to the strips 10 and 20 in order to ensure that the bag is sealed. It must also extend to the side edge 12 of the bag.

Providing these conditions are complied with, the bag is completely leakproof when closed, since the zone of heat sealing 62 closes the passage kept open between the strips 10 and 20 ahead of the cursor 50.

It will also be observed that the zone of heat sealing 62 provides a hard point in displacement of the cursor 50 when the cursor reaches said zone 62. This serves in particular to prevent the cursor 50 moving on its own in untimely manner into the open position.

In a variant, the connection zone 62 between the inside walls of the bag can be provided by adhesive, rather than by heat sealing.

Figure 4:
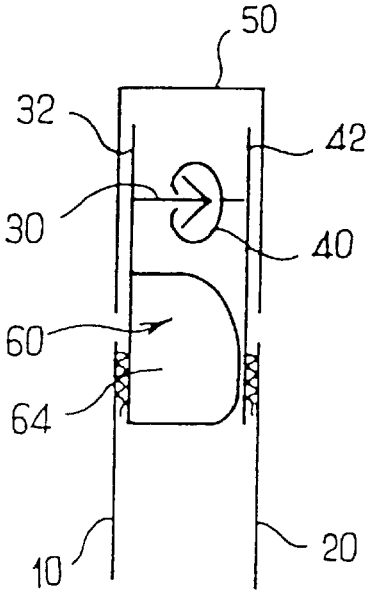
FIGS. 4 and 5 are cross-section views of the mouths of bags forming two variants of a second embodiment of the present invention.
Figure 5:
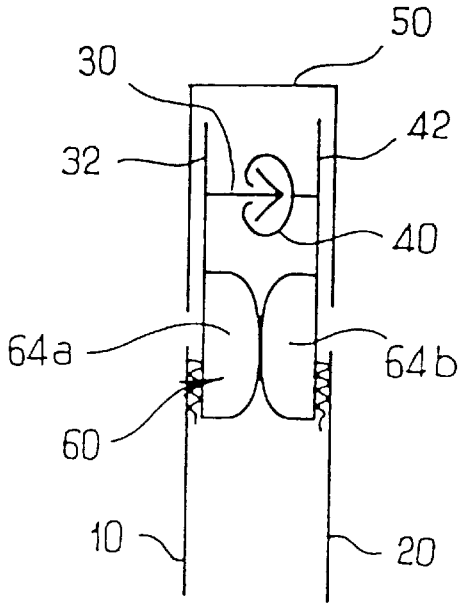

FIGS. 4 and 5 show the mouth of a bag constituting a second embodiment of the present invention in which the means 60 are constituted by an extra thickness 64 between the inside walls of the bag.

The extra thickness 64 may be single, being provided on one of the inside walls of the bag as shown in FIG. 4, or else it may be symmetrical with respective extra thicknesses 64*a* and 64*b* being provided on the two walls of the bag, as shown in FIG. 5.

Such extra thicknesses can, for example, be as described in document FR-A-2 630 406.

The extra thicknesses 64 may be provided over the entire length of the strips 30 and 40 or they may be restricted to the zone of the bag underlying the strips close to their end that receives the cursor 50 in the closed position.

The extra thickness(es) 64 are preferably provided on the inside surfaces of the webs 32 and 42, as shown in FIGS. 4 and 5. Nevertheless, in a variant, it is possible to envisage making the extra thickness(es) on the inside surfaces of the films 10 and 20.

Figure 6:
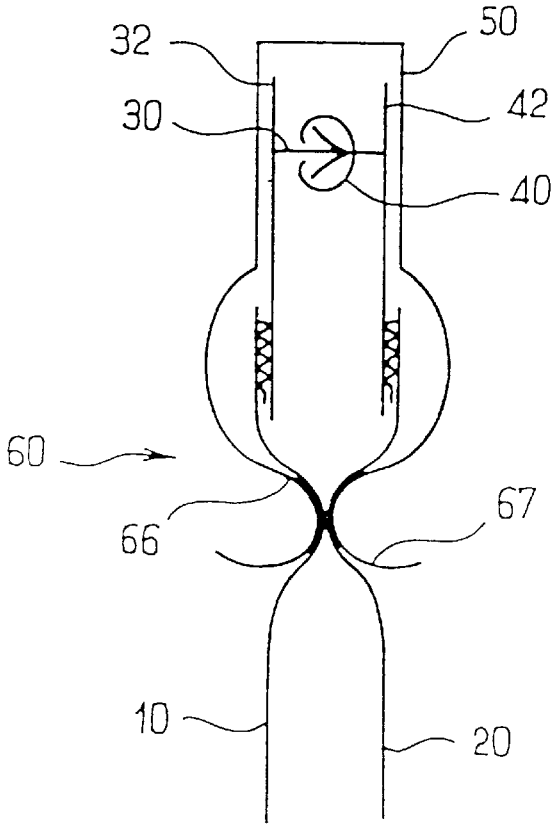
FIG. 6 is a cross-section view of the mouth of a bag constituting a third embodiment of the present invention.

FIG. 6 shows the mouth of a bag constituting a third embodiment of the present invention in which the means 60 are constituted by a clip associated with the cursor 50. The clip has two jaws 66 and 67 respectively connected to the side flanks of the cursor 50 and adapted to press resiliently against the outside surfaces of the films 10 and 20 in the zone of the bag underlying the strips 30 and 40, at their end that receives the cursor 50 in the closed position.

Such jaws 66 and 67 can be implemented in numerous ways. They are therefore not described in detail below.

Nevertheless, it should be observed that essentially the jaws 66 and 67 extend along the entire length of the cursor 50.

As shown diagrammatically in FIG. 7, auxiliary jaws 68 and 69 can be provided on the rear end of the cursor to perform the same function of clipping together the walls of the bag so as to improve sealing thereof, and auxiliary walls can even be applied, where appropriate, to the front end of the cursor 50.

FIG. 8 shows the mouth of a bag constituting a fourth embodiment of the present invention. The bag is characterized by the fact that it has two parallel closure assemblies: a first closure assembly 30, 40 and a second closure assembly 130, 140. The first closure assembly, adjacent to the mouth, is made of complementary strips 30 and 40 carried where appropriate by support webs 32 and 42 fitted to the films 10 and 20 and actuated for opening and closing by the cursor 50 as mentioned above. The second closure assembly 130, 140 is placed on the inside of the first assembly 30, 40. It also extends over the entire length of the mouth of the bag. The second assembly 130, 140 is actuated for closing purposes by the cursor 50, but it is opened manually.

Figure 9:
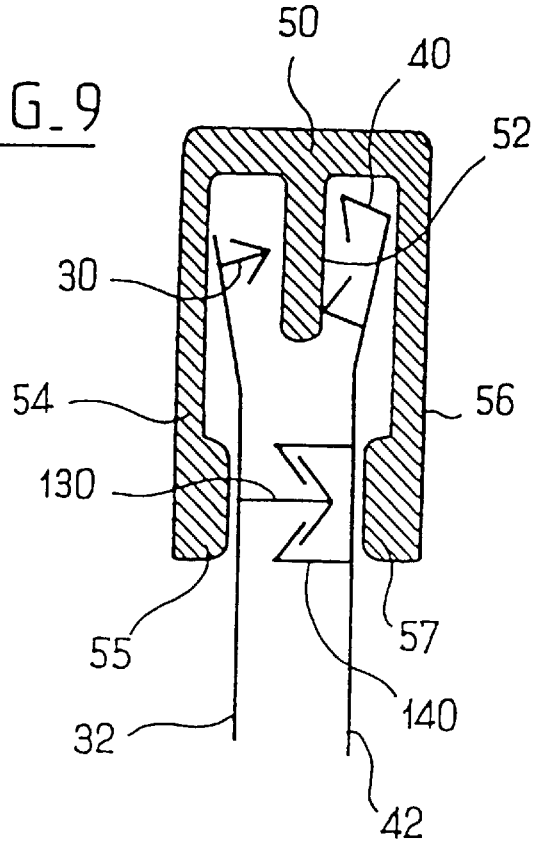
FIGS. 9 and 10 are cross-section views of said mouth.
Figure 10:
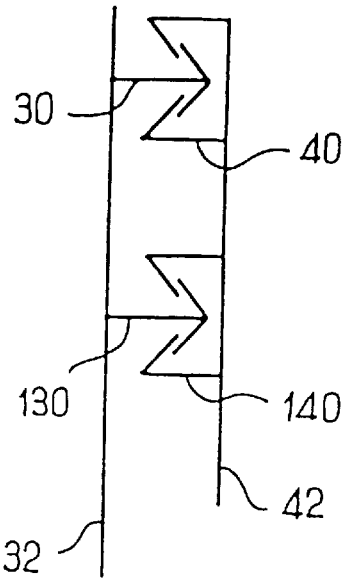

The second assembly 130, 140 can be made of complementary closure strips suitable for mutual engagement that are identical or equivalent to the strips 30 and 40 of the first assembly, as shown in FIGS. 9 and 10. Nevertheless, in a variant, the second assembly 130, 140 can be constituted merely by a baffle made up, for example, of a rib 130 secured to the web 32 and extending transversely thereto, being designed to be received in the closed position between two mutually parallel ribs 140*a*, 140*b* secured to the web 42 and extending transversely thereto, as shown in FIG. 11.

In addition, the second closure assembly 130, 140 is heat sealed to guarantee sealing at its end which corresponds to the cursor in the closed position. The heat sealing referenced 62 in FIG. 8 is preferably of length L1 greater than the length of the cursor 50.

Naturally, the second closure assembly and the heat sealing 62 are placed as close as possible to the first closure assembly 30, 40 and preferably touching it.

Figure 11:
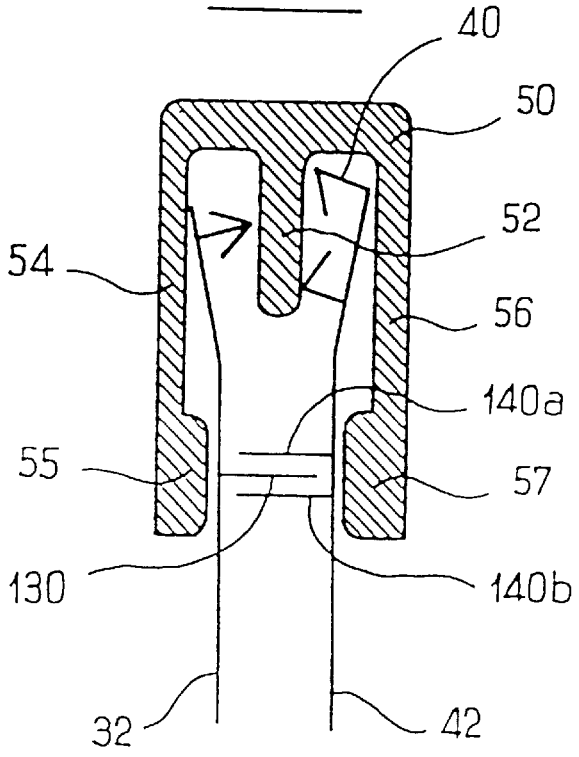
FIG. 11 is a cross-section view of the mouth of a bag constituting a variant of the fourth embodiment.

FIGS. 9 and 11 show a cursor 50 suitable for co-operating with both closure assemblies 30, 40 and 130, 140. The cursor 50 is essentially constituted by a channel section piece having a central partition 52 of length adapted to penetrate between the strips 30 and 40 of the first closure assembly for the purpose of opening said first assembly, without interfering with the second closure assembly 130, 140. The main parallel flanges 54 and 56 of the cursor 50 also have on their inside surfaces, projections 55 and 57 adapted during closure to cause the strips 30 & 40 and 130 & 140, and/or the baffle elements 130, 140*a*, & 140*b* to move together and engage mutually.

Naturally, the present invention is not limited to the particular embodiments described above, but extends to all variants within the spirit of the invention.

In particular, the invention applies to any type of film previously fitted with closure strips, e.g. by being coextruded with said strips, or optionally receiving the strips, e.g. by heat sealing or sticking on the webs 32 and 42 while the bags are being made. Means designed to perform such assembly by adhesive are described, for example, in document FR-A-2 485 895.

The present invention can be used in the manufacture of bags on form, fill and seal (FFS) machines designed to perform automatically the operations of forming, filling, and sealing bags. In this context, the closure strips can be disposed longitudinally or transversely relative to the travel direction of the film.

Bags of the present invention may naturally also combine the dispositions shown in the accompanying figures, i.e. those of the first, second, third, and fourth embodiments respectively as described above.

What is claimed is:

1. A bag having complementary closure strips actuated by a cursor to open and close the bag, wherein the cursor comprises two parallel flanges defining a channel configured to receive the complementary closure strips, and a central partition in the channel configured to penetrate between the closure strips to separate the closure strips when the cursor is actuated to open the bag, and wherein the bag comprises additional means, other than the complementary closure strips, underlying the closure strips and disposed at an end of the closure strips received by the cursor when the bag is closed, the additional means configured to seal the inside walls of the bag when the bag is closed even though the central partition of the cursor is placed between the closure strips.

2. The bag according to claim 1, wherein the additional means is formed by heat sealing a limited length of the inside walls of the bag in a zone underlying the strips at the end of the closure strips received by the cursor when the bag is closed.

3. The bag according to claim 2, wherein the sealed zone is made between support webs for the closure strips.

4. The bag according to claim 2, wherein the length of the sealed zone measured parallel to the closure strips is greater than the length of the cursor.

5. The bag according to claim 2, wherein the sealed zone has a length of about 1.5 cm, and a width of about 1 mm to 2 mm.

6. The bag according to claim 1, wherein the additional means is formed by adhesive between a limited length of the inside walls of the bag in a zone underlying the closure strips at the end of the closure strips received by the cursor when the bag is closed.

7. The bag according to claim 1, wherein the sealed portion of the inside walls runs into the side edge of the bag.

8. The bag according to claim 1, wherein the additional means is formed by at least one projection between the inside walls of the bag in a zone underlying the strips at the end of the closure strips received by the cursor when the bag is closed.

9. The bag according to claim 8, wherein the bag has a single extra thickness on one of the inside walls of the bag.

10. The bag according to claim 8, wherein the bag has symmetrical extra thicknesses on each of two walls of the bag, respectively.

11. The bag according to claim 8, wherein each extra thickness is provided along the entire length of the closure strips.

12. The bag according to claim 8, wherein each extra thickness is restricted to a zone of the bag underlying the closure strips at the end of the closure strips received by the cursor when the bag is closed.

13. The bag according to claim 1, wherein the additional means to seal includes clip means provided on the cursor, said clip means configured to clip together a zone underlying the closure strips at the end of the closure strips received by the cursor when the bag is closed.

14. The bag according to claim 13, wherein the clip means comprise two jaws connected to respective lateral flanks of the cursor and configured to press resiliently against outside faces of the bag in the zone of the bag underlying the closure strips at the end of the closure strips received by the cursor when the bag is closed.

15. The bag according to claim 14, wherein the jaws extend over the entire length of the cursor.

16. The bag according to claim 13, wherein auxiliary jaws are disposed on the rear or front end of the cursor for the purpose of pressing together the inside walls of the bag.

17. The bag according to claim 1, wherein webs carrying the closure strips are fixed to the walls of the bag.

18. The bag according to claim 17, wherein the walls have a heat sealing temperature higher than that of the webs carrying the strips.

19. The bag according to claim 17, wherein the webs are made of a material selected from polyethylene, ethylene-propylene copolymers, and EVA copolymers, while the films are made of a material selected from polypropylene, ethylene-propylene copolymers, mixtures of polypropylene and ethylene-propylene copolymers, and/or terpolymers.

20. The bag according to claim 1, wherein webs carrying the closure strips are fixed on the outsides of the walls of the bag.

21. The bag according to claim 20, wherein the walls have a heat sealing temperature lower than that of the webs carrying the closure strips.

22. The bag according to claim 20, wherein the webs are made of a material selected from polypropylene, ethylene-propylene copolymers, mixtures of polypropylene and of ethylene-propylene copolymers and/or terpolymers, and polyamides, while the films are made of a material selected from polyethylene, ethylene-propylene copolymers, and EVA copolymers.

23. The bag according to claim 1, wherein the additional means is formed by a closure or a baffle situated beneath the closure strips adjacent to a mouth of the bag and closed by actuation of the cursor, further wherein an end of the closure or baffle corresponding to a position of the cursor when the bag is closed is heat sealed to provide sealing.

24. The bag according to claim 23, wherein the closure touches the closure strips.

25. A bag having complementary closure strips actuated by a cursor to open and close the bag, wherein the cursor comprises two parallel flanges defining a channel configured to receive the closure strips, and a central partition in the channel configured to penetrate between the strips to separate the strips when the cursor is actuated to open the bag, and wherein the bag comprises a connection zone underlying the closure strips at an end of the closure strips received by the cursor when the bag is closed, said connection zone being of limited length compared to the closure strips along the inside walls of the bag and configured to seal the inside walls of the bag when the bag is closed even though the central partition of the cursor is between the closure strips, said connection zone having a length measured parallel to the closure strips greater than the length of the cursor and extending to a side edge of the bag.

26. A bag having complementary closure strips actuated by a cursor to open and close the bag, wherein the cursor comprises two parallel flanges defining a channel configured to receive the closure strips, and a central partition in the channel configured to penetrate between the closure strips to separate the closure strips when the cursor is actuated to open the bag, and wherein the bag comprises a sealed connection zone underlying the closure strips at an end of the closure strips received by the cursor when the bag is closed and having a length slightly greater than the length of the cursor along the inside walls of the bag and extending to a side edge of the bag, wherein the sealed connection zone is configured to seal the inside walls of the bag when the bag is closed even though the central partition of the cursor is placed between the closure strips.

27. A bag having complementary closure strips actuated by a cursor to open and close the bag, wherein the cursor comprises two parallel flanges defining a channel suitable for receiving the closure strips, and a central partition in the channel configured to penetrate between the closure strips to separate the closure strips when the cursor is actuated to open the bag, and wherein the bag comprises a connection zone formed by adhesive between the inside walls of the bag, the adhesive connection zone underlying the closure strips at an end of the closure strips received by the cursor when the bag is closed and having a length slightly greater than the length of the cursor along the inside walls of the bag and extending to a side wall of the bag, wherein the adhesive connection zone is configured to seal the inside walls of the bag when the bag is closed even though the central partition of the cursor is placed between the closure strips.

28. A bag having complementary closure strips actuated by a cursor to open and close the bag, wherein the cursor comprises two parallel flanges defining a channel configured to receive the closure strips, and a central partition in the channel configured to penetrate between the closure strips to separate the cursor strips when the cursor is actuated to open the bag, and wherein the bag comprises at least one projection between the inside walls of the bag, said projection underlying the closure strips at an end of the closure strips received by the cursor when the bag is closed and configured to seal the inside walls of the bag when the bag is closed even though the central partition of the cursor is placed between the closure strips.

29. A bag having complementary closure strips actuated by a cursor to open and close the bag, wherein the cursor comprises two parallel flanges defining a channel configured to receive the closure strips, and a central partition in the channel configured to penetrate between the closure strips to separate the closure strips when the cursor is actuated to open the bag, and wherein the bag comprises a clip provided on the cursor, the clip comprising two resilient jaws connected to the respective flanges of the cursor and configured to press resiliently against outside faces of the bag underlying the closure strips at the end of the closure strips received by the cursor when the bag is closed to seal the inside walls of the bag when the bag is closed even though the central partition of the cursor is placed between the closure strips.

30. A bag having complementary closure strips actuated by a cursor to open and close the bag, wherein the cursor comprises two parallel flanges defining a channel configured to receive the closure strips, and a central partition in the channel configured to penetrate between the closure strips to separate the closure strips when the cursor is actuated to open the bag, and wherein the bag comprises a baffle underlying the closure strips adjacent to a mouth of the bag, said baffle being closed by the cursor and an end of the baffle corresponding to a position of the cursor when the bag is closed being heat sealed to seal the inside walls of the bag when the bag is closed even though the central partition of the cursor is placed between the closure strips.

* * * * *